US008516971B1

(12) United States Patent
Natoce

(10) Patent No.: US 8,516,971 B1
(45) Date of Patent: Aug. 27, 2013

(54) MODULAR CONFIGURABLE MARINE UTILITY VESSEL

(75) Inventor: Douglas Natoce, Edgewater, FL (US)

(73) Assignee: Brunswick Commercial and Government Products, Inc., Edgewater, FL (US)

( * ) Notice: Subject to any disclaimer, the term of this patent is extended or adjusted under 35 U.S.C. 154(b) by 349 days.

(21) Appl. No.: 12/720,241

(22) Filed: Mar. 9, 2010

Related U.S. Application Data

(60) Provisional application No. 61/158,524, filed on Mar. 9, 2009.

(51) Int. Cl.
*B63B 17/00* (2006.01)

(52) U.S. Cl.
USPC ..... 114/85; 114/343; 114/364

(58) Field of Classification Search
USPC ..... 244/118.1; 114/85, 77 A, 77 R, 114/357, 364, 343
See application file for complete search history.

(56) References Cited

U.S. PATENT DOCUMENTS 2,529,148 A * 11/1950 Fratt ..... 248/515
4,579,073 A 4/1986 Sadler et al.
4,624,209 A * 11/1986 Loffler ..... 114/354
4,658,747 A 4/1987 Franz et al.
4,856,446 A * 8/1989 Herard ..... 114/61.22
5,359,954 A 11/1994 Kordelin
5,676,088 A * 10/1997 Blaisdell et al. ..... 114/357
6,739,281 B1 5/2004 Grimes
7,146,927 B1 * 12/2006 Wright ..... 114/364
7,281,487 B1 10/2007 Placek
7,478,817 B1 1/2009 Carrier

* cited by examiner

*Primary Examiner* — Edwin Swinehart

(74) *Attorney, Agent, or Firm* — Malin Haley DiMaggio & Bowen, P.A.

(57) ABSTRACT

A system and apparatus for providing modular configurable marine utility vessels which allow for selective arrangement, quick release, and rapid rearrangement of deck components such as the console, seating, military and utility equipment, and accessory items. The vessel includes a plurality of deck modules which form one or more deck platforms. The deck module includes an upper deck section and a lower frame section, the upper deck sections have channels for receiving and interlocking with the lower frame sections. The deck modules also include numerous hardware fittings which form a geometric grid pattern that allows for numerous distinct deck layouts for equipment depending on desired missions or end uses.

12 Claims, 4 Drawing Sheets

EMPTY GRID IN DECK WITH UNIFORM BOLT PATTERN AND CENTERLINE RIGGING ACCESS PLATES

EXAMPLE LAYOUT #1: CONFIGURATION FOR AFT CONSOLE AND 17 SHOCK MITIGATING SEATS

EXAMPLE LAYOUT #2: FORWARD CONSOLE, 10 MAN BENCH SEAT AND LEANING POST, 4 CARGO TIE DOWNS, STERN TOW POST, AND FWD GUN MOUNT

MODULAR CONFIGURABLE MARINE UTILITY VESSEL

CROSS REFERENCE TO RELATED APPLICATIONS

This utility patent application claims priority from Applicant's provisional patent application of the same title filed on Mar. 9, 2009, Ser. No. 61/158,524.

STATEMENT REGARDING FEDERALLY SPONSORED RESEARCH OR DEVELOPMENT

N/A

BACKGROUND OF THE INVENTION

1. Field of the Invention

This invention relates generally to marine vessels, and more particularly to a novel method and apparatus for providing modular and configurable utility boat which can be selectively designed and/or utilized to arrange, and rapidly rearrange, deck structure for a variety of different end uses. The designs disclosed have particular application for utility boats, commercial boats, special application and industrial work vessels, military and law enforcement craft. Additional uses relate to boats specially designed for fire and rescue operations, harbor tenders, charter fishing, commercial diving, piloting and/or offshore drilling shuttles.

2. Description of the Prior Art

Prior designs relate to utility, commercial and industrial boats. The prior art includes many such boats of different designs, but the boats are manufactured with deck, hull, cockpit, helm, console and seating arrangement that are essentially permanent. The layouts cannot be changed when components such as center consoles, seats, davits, weapon mounts, shock mitigation apparatus, storage boxes, lean posts and such ancillary equipment are installed in the original manufacture and assembly of the vessel. The boats use mission specific platforms, and practically cannot be changed, or changing the deck and layout of these components would require major down time and "re-manufacturing" in marina or manufacturer's facility. This is cost-prohibitive and is not generally practiced in the marine industry. In any event, the prior art does not provide for marine vessels having Applicant's designs, structure and function wherein the end-user can selectively arrange and rearrange the internal deck layout, structure, equipment and/or loads to accommodate any type of special operations.

SUMMARY OF THE INVENTION

The instant inventions provide for configurable marine crafts that allow for the end user to rapidly remove, add or change vessel internal layout for specific missions. The desired configuration of the deck structure can be rapidly arranged and subsequently rearranged by using simple hand tools to meet any mission using one main vessel instead of several. Instead of having a fleet of mission specific platforms, the end user can rapidly swap components in a matter minutes.

The configurable craft design allows for the fast relocation of virtually all deck equipment, including the helm or console itself, personnel, occupant or operator seating, weaponry, davits, masts, fire and rescue equipment, railings and posts, load securing hardware, storage cabinets, food and beverage containers, supply and equipment lockers, and the like.

The novel deck designs provide a plurality of hardware fittings, support structure, and rig access plates which are flush with, and incorporated into, the deck itself. The deck includes uniform hardware patterns and any desired access plate locations to accommodate desired uses. The deck further includes supporting frame components. Deck components and equipment can be rapidly relocated to any of the existing fittings or plates such that the entire deck space is available for use with myriad platform layouts.

BRIEF DESCRIPTION OF THE DRAWINGS

The invention may be better understood by reference to the drawings in which.

DETAILED DESCRIPTION OF PREFERRED EMBODIMENTS

Applicant's marine vessels designs and the inventions set forth herein relate to special custom commercial, utility and industrial work boats. These boats are designed for carrying relatively heavy payloads, and are further used by governmental agencies, police departments, armed services and the Coast Guard, for example, for very specific end uses. These uses include search and rescue missions, towing operations, and other specialized industrial applications which include mounting and maintaining heavy, bulky and/or specialized equipment on the vessel itself. In terms of police and military applications, these boats are designed to mount firearms, surveillance and electronic equipment, and other weaponry. The boats are also capable carrying any type of large, awkward, bulky and/or heavy payloads for rapid loading, deployment, delivery and unloading operations. In addition, the design and layout of the deck structure can be rapidly changed to accommodate personnel, seating arrangements, operator console location, weaponry type and location, stabilizing equipment for the deck, and any type of ancillary equipment.

Figure 1A:
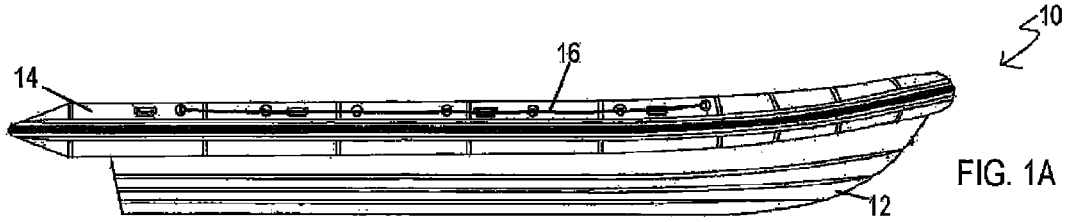
FIG. 1A is a side elevational view of a boat incorporating the instant inventions.

With reference to FIG. 1A, a side view of a modular configurable marine vessel 10 incorporating the instant invention is shown. Externally, this particular model is a typical hull with the lower section 12 and upper section 14. Upper section 14 is similar to the inflatable portion of a conventional RIB vessel (rigid inflatable boat), and can include stability lines or ropes 16. It is important to note, however, that the novel deck and modules of Applicant's designs can be incorporated into any type of marine vessel. Propulsion means and outboard motors would be attached in conventional fashion.

Figure 1B:
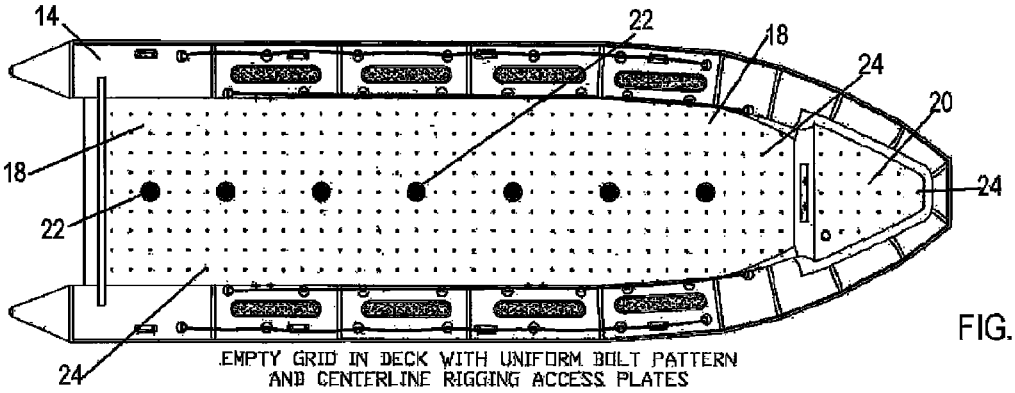
FIG. 1B is top plan view of the boat shown in FIG. 1A, and depicting the deck grid prior to installation of deck components.

FIG. 1B depicts a top view of the boat shown in FIG. 1A. This model includes a main deck 18, and an optional secondary elevated deck 20 in the bow of the vessel. The decks are formed with deck sections or custom modules as described hereinafter. Decks 18 and 20 illustrate the centerline placement of a plurality of access plates 22, which are generally positioned about the longitudinal axis of the vessel. The empty grid pattern for securing means 24 is also shown. The strategic placement and use of rigging access plates 22 and securing means 24 for selective use in any desired platform can accommodate innumerable layouts for control consoles, seating, loads, deck structure and/or equipment. The plates and securing means also provide the capability and function of allowing for the rapid and effective rearrangement or change of deck components to a new configuration for entirely different applications, missions or end uses.

Figure 1C:
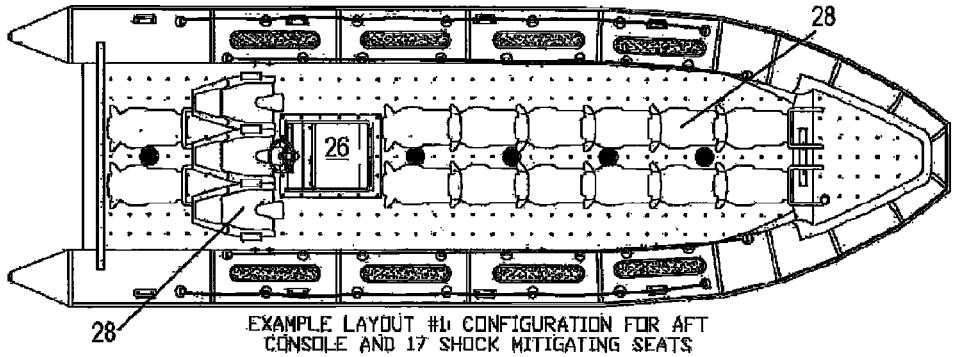
FIG. 1C is top plan view of the boat shown in FIG. 1A, depicting a first configuration and platform layout for deck components.

FIG. 1C illustrate a first configuration for a platform and deck layout, with an aft placement of the operator console 26 and the placement of seventeen (17) separate shock mitigating seats 28 for military personnel.

Figure 1D:
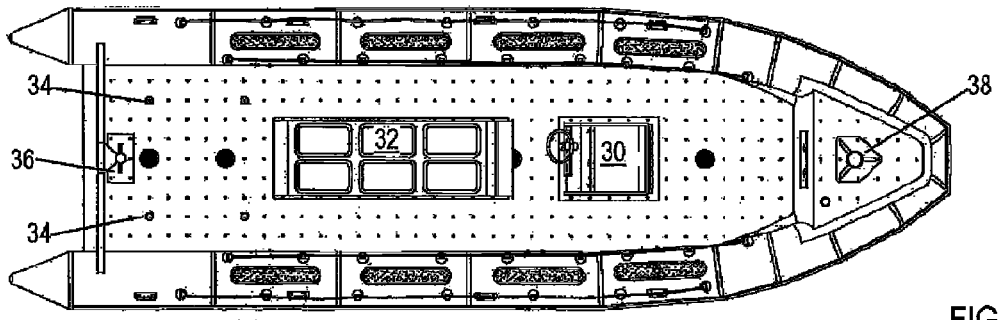
FIG. 1D is top plan view of the boat shown in FIG. 1A, depicting a second configuration and platform layout for deck components.

FIG. 1D is a completely different and second configuration for a platform and deck layout, with the placement of a forward operator console 30, ten (10) man bench seat 32 with leaning post, four (4) cargo tie downs 34, stern tow post 36, and forward gun mount 38.

It will be appreciated by one of ordinary skill in the art that Applicant's inventions provide for myriad configurations for platforms, deck layouts and components. Depending on the specific missions, end uses and equipment, virtually all deck components can be quickly and efficiently changed, and a vessel of one type can be literally transformed into an entirely different boat. A quick strike boat for soldiers or sailors with specific weapons such as mounted machine guns or rocket launchers can be transformed into a search and rescue vehicle with specialized equipment used for locating, stabilizing and retrieving personnel in distress, transporting special loads, supplies or equipment, or used for surveillance missions with sophisticated electronics and defense equipment. There are no limits to possible uses.

Figure 2:
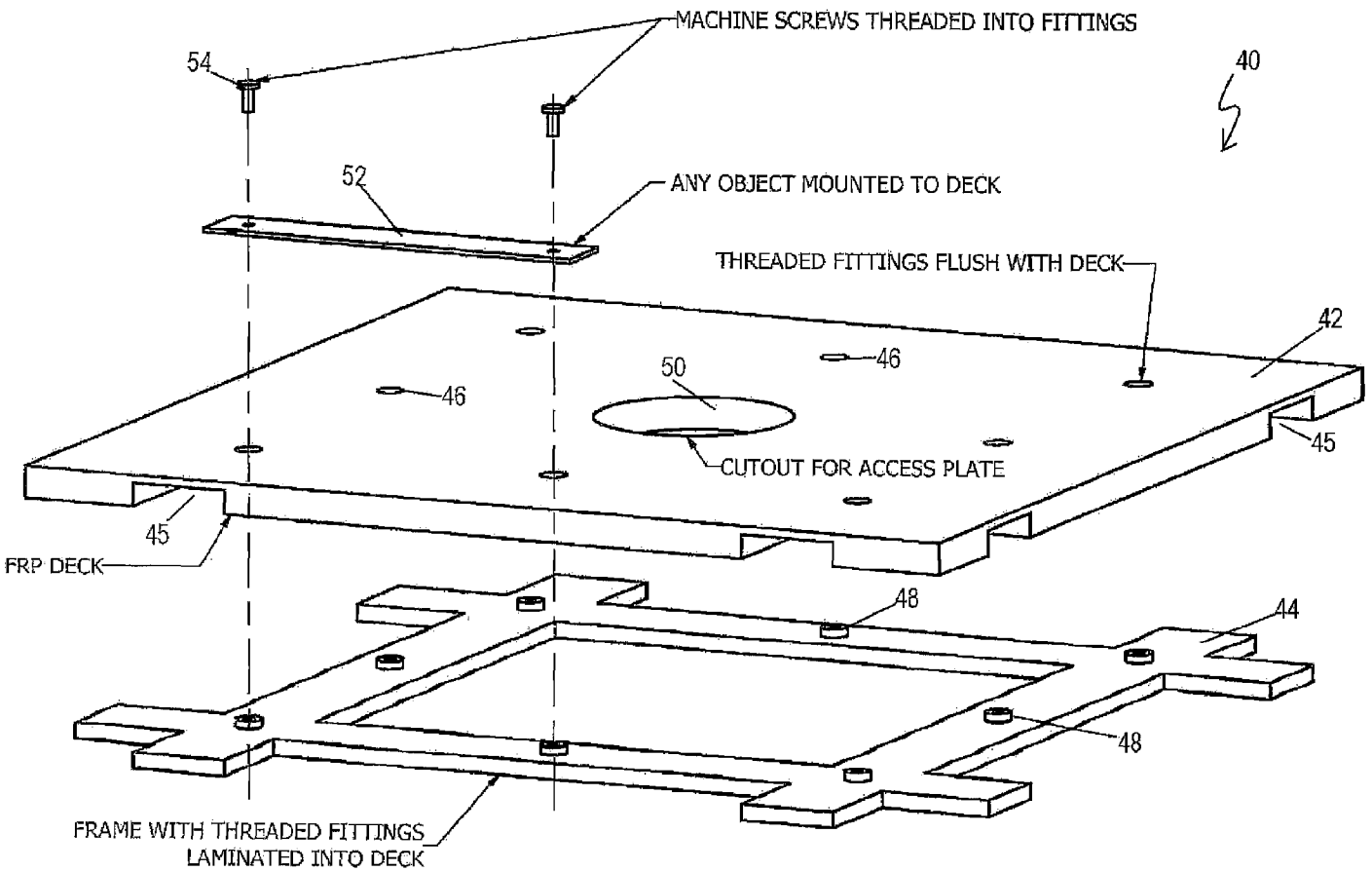
FIG. 2 is an exploded perspective view illustrating the deck structure of the instant inventions

FIG. 2 illustrates a perspective and exploded view of module 40 used as a section in the assembly of Applicant's deck 18. Module 40 generally includes upper deck section 42 and lower frame section 44. Upper deck section 42 includes a plurality of securing means 46, which can be threaded fittings to receive screws or bolts, and the securing means are flush with the deck. The modular section can further include one or more cutouts or recesses 50 to receive access plates. The bottom of upper deck section 42 contains channels 45 to receive lower frame section 44.

Lower frame section 44 also includes a plurality of fittings that are laminated into the deck, and can be threaded to receive screws or bolts. Upper deck section 42 received, and is secured to, lower frame section 44 as the frame section is placed with the channels. The frame is geometrically complementary to the upper section channels, and is interlocked within the upper section.

Various deck components and any type of object can be mounted to the deck. The base portion 52 of such an object would be secured to the deck using machine screws 54 (or the like), which are secured in threaded engagement with deck fittings 46 and frame fittings 48. As will be appreciated, the layout and exact pattern of deck fittings is a matter of design choice.

Figure 3:
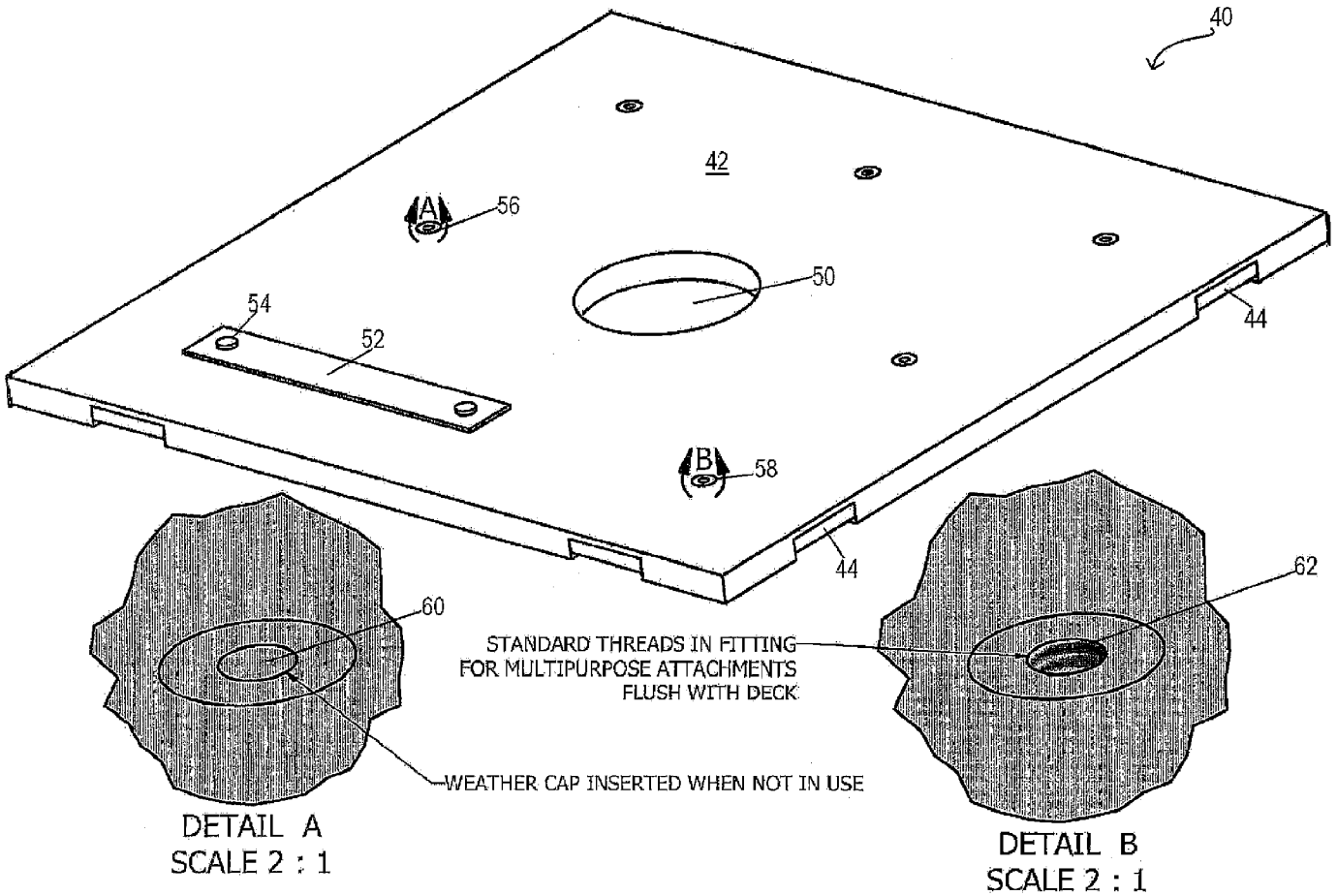
FIG. 3 is a perspective view of an assembled deck section module shown in FIG. 2.

FIG. 3 is a perspective view of the assembled module 40. Lower frame section 44 is shown assembled within upper deck section 42. Object base member 52 is installed and secured to the deck by hardware 54. Weather caps 60 are utilized to seal deck fittings which are not in use. Standard threaded fittings 62 are flush with the deck and can be used for multipurpose attachments. Cutout 50 for an access plate is also shown.

Figure 4:
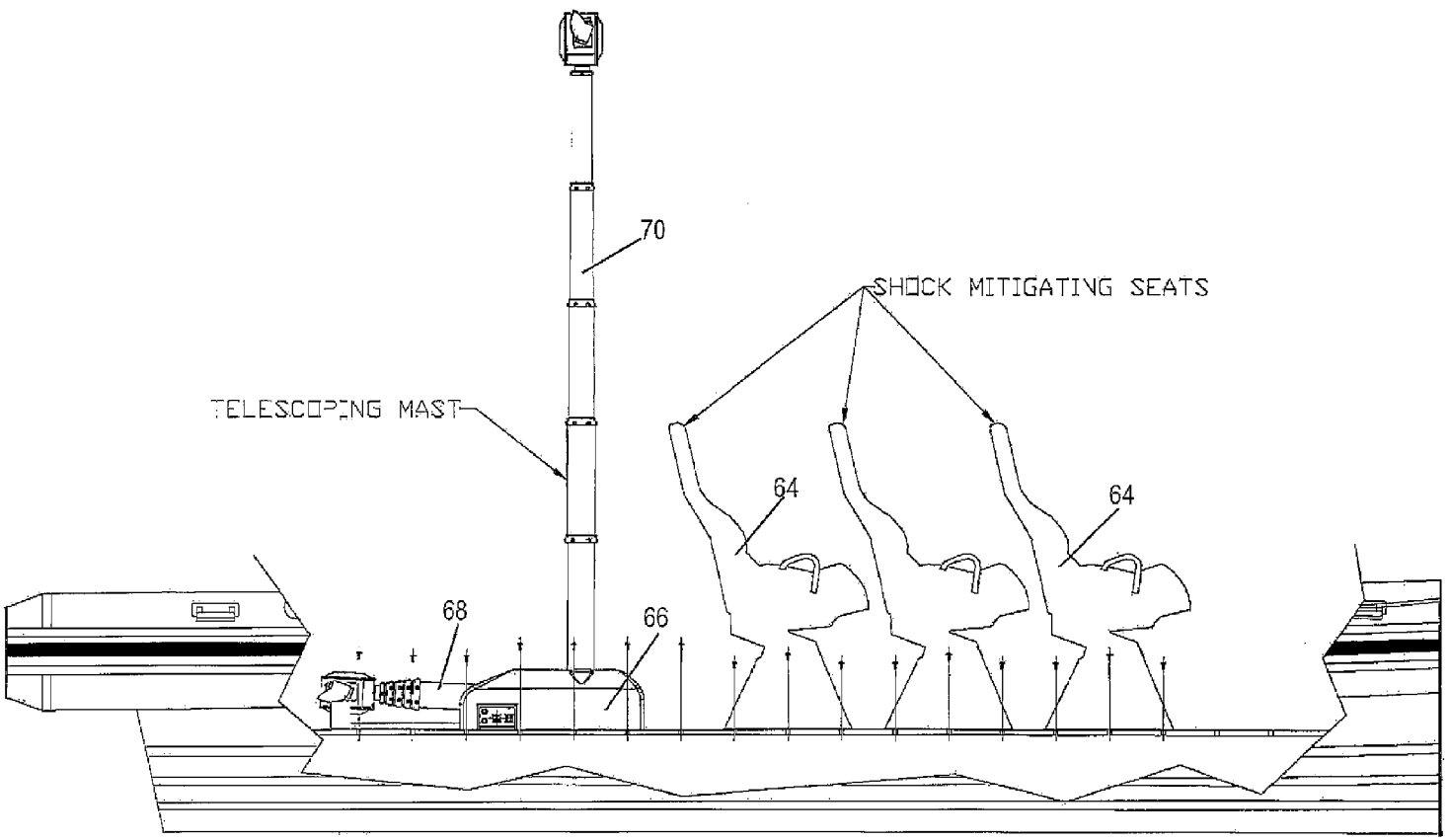
FIG. 4 is a partially side cut-away view of the boat shown in FIG. 1A with deck components installed.

FIG. 4 illustrates a partially cut-away side view a one configuration for a modular military configurable water craft having shock mitigating seats 64, and a telescoping mast 70. Seats 64 and mast base 66 are secured to the vessel deck using the attachment and securing means illustrated in FIGS. 2 and 3. That is, the seats and mast base have lower-most members which are secured directly to the deck modules using appropriate hardware with the deck and frame fittings. The telescoping mast 70 articulates from a retracted deck position 68 to a vertical and extended position for mast 70. Any such mast can be used for a variety of purposes such as rigging, supporting ancillary equipment, and/or mounting electronics.

The above referenced description, drawings and artistic renditions illustrate to one of ordinary skill in the art, how to manufacture, assemble and utilize the instant modular and configurable marine vessel.

The instant inventions have been shown and described herein in what is considered to be the most practical and preferred embodiments. It is recognized, however, that departures may be made therefrom within the scope of the inventions and that obvious modifications will occur to a person skilled in the art.

What is claimed is:

1. A modular configurable deck assembly for a marine vessel, for selective arrangement and rapid rearrangement of deck components, comprising:

a plurality of deck modules, said plurality of deck modules forming a deck platform adapted to be disposed within an interior of said marine vessel;

each said deck module having a deck section and a frame section;

said deck section having a deck surface and a bottom surface;

said deck surface including a plurality of hardware fitting apertures, said bottom surface including a plurality of recessed channels for receiving said frame section;

said frame section securely fitting within, and interlocked to, said deck section thereby forming said deck module.

2. The apparatus of claim 1 wherein said deck section further includes a plurality of means for securing said deck components, said plurality of means for securing housed within said plurality of hardware fitting apertures.

3. The apparatus of claim 2 wherein said plurality of means for securing deck components are flush with said deck section.

4. The apparatus of claim 1 wherein said deck section further includes a plurality of access apertures providing access beneath said deck module within the interior of said marine vessel.

5. The apparatus of claim 2 wherein said plurality of means for securing said deck components constitutes a uniform grid pattern for said deck platform.

6. The apparatus of claim 2 wherein said frame section further includes a plurality of means for securing deck components.

7. The apparatus of claim 6 wherein said deck section plurality of means for securing deck components and said frame section plurality of means for securing deck components are complementary and coaxial.

8. The apparatus of claim 7 wherein said frame section plurality of means for securing deck components are laminated within said deck module.

9. A modular configurable deck assembly for a marine utility vessel, for selective arrangement and rapid rearrangement of deck components, comprising:

a plurality of deck modules, said plurality of deck modules forming a deck platform adapted to be disposed within an interior of said marine vessel;

each said deck module having a deck section and a frame section;

said deck section having a deck surface and a bottom surface;

said deck surface including a plurality of hardware fitting apertures, said bottom surface including a plurality of recessed channels for receiving said frame section;

said deck section further including a plurality of means for securing said deck components, said plurality of means for securing housed within said plurality of hardware fitting apertures;

said frame section securely fitting within, and interlocked to, said deck section thereby forming said deck module;

said frame section further including a plurality of means for securing deck components;

said deck section plurality of means for securing deck components and said frame section plurality of means for securing deck components being complementary and coaxial.

10. The apparatus of claim 9 wherein said deck section plurality of means for securing said deck components constitutes a uniform grid pattern for said deck platform.

11. The apparatus of claim 9 wherein said deck section further includes a plurality of access apertures providing access beneath said deck module within the interior of said marine vessel.

12. The apparatus of claim 9 wherein said plurality of means for securing deck components constitutes threaded fittings.

* * * * *